US005865130A

United States Patent [19]

Jamison et al.

[11] Patent Number: 5,865,130

[45] Date of Patent: Feb. 2, 1999

[54] SELF-CLEANING THERMAL OXIDIZER

[75] Inventors: Robert D. Jamison; David E. Peterson, both of Tuscaloosa, Ala.

[73] Assignee: Sunbelt Resources, Inc., Tuscaloosa, Ala.

[21] Appl. No.: 855,110

[22] Filed: May 13, 1997

[51] Int. Cl.[6] ..... F23B 5/00

[52] U.S. Cl. ..... 110/212; 110/214; 110/313; 432/72; 432/75

[58] Field of Search ..... 110/210, 216, 110/212, 345, 214, 348, 313; 432/5, 252, 26, 64, 72, 75, 301

[56] References Cited

U.S. PATENT DOCUMENTS

| | | | |
|---|---|---|---|
| 4,038,032 | 7/1977 | Brewer et al. | 436/55 |
| 4,368,677 | 1/1983 | Kline | 110/345 X |
| 4,883,003 | 11/1989 | Hoskinson | 110/212 |
| 5,145,362 | 9/1992 | Obermueller | 432/72 |
| 5,199,362 | 4/1993 | Carter | 110/345 X |
| 5,395,596 | 3/1995 | Winkin et al. | 110/245 X |
| 5,662,050 | 9/1997 | Angelo, II et al. | 110/246 |
| 5,700,433 | 12/1997 | Somary | 431/5 X |

*Primary Examiner*—Henry A. Bennett
*Assistant Examiner*—Susanne C. Tinker
*Attorney, Agent, or Firm*—Smith Patent Office

[57] ABSTRACT

An apparatus for self cleaning a thermal oxidizer that is thermally treating and decontaminating gases is disclosed. The apparatus for self cleaning the thermal oxidizer can clean the accumulated dust out from inside the thermal oxidizer without requiring disassembly of the unit. The apparatus for self cleaning can also accomplish this cleaning cycle without interrupting the normal operation of the thermal oxidizer. Dust cleaned out from the apparatus for self cleaning the thermal oxidizer is decontaminated by the same thermal treatment that decontaminates the gases processed by the thermal oxidizer. Many of the existing thermal oxidizers already in operation can be retrofitted to become self cleaning thermal oxidizers. It is also possible to include the apparatus for self cleaning in a new thermal oxidizer.

11 Claims, 7 Drawing Sheets

SELF-CLEANING THERMAL OXIDIZER

BACKGROUND OF THE INVENTION

1. Field of the Invention

The invention relates to a method and apparatus for cleaning out particulate matter (dust) that accumulates inside of thermal oxidizers. This invention proposes a means for cleaning the dust out of a thermal oxidizer, without disassembly, during or while the thermal oxidizer is shut down.

2. Description of the Related Art

Thermal oxidizers are used in a variety of systems and processes to decontaminate exhaust and waste gases produced elsewhere in a system or process. Increasingly, thermal oxidizers are being used to treat exhaust gases generated by the thermal treatment of contaminated soil by soil remediation systems. The soil remediation process creates exhaust gases containing much more very fine particulate matter (dust of 150 microns or less in diameter) than previously encountered in other, non-soil, remediation systems that use thermal oxidizers. This application of thermal oxidizers in soil remediation systems requires much more frequent cleaning of dust out from their interiors than previously encountered by other thermal oxidizers used for other processes. Prior to this invention thermal oxidizers had dust cleaned out of them by means that required the unit to be shut down, cooled down (usually taking 4 to 6 days), disassembled, and then manually cleaned out. Another previous practice was the inclusion of separate and additional mechanisms and/or apparatuses to physically remove the dust from the flue gases prior to its entry into the thermal oxidizer.

Krigmont et al. (U.S. Pat. No. 4,987,839) disclose a system for the removal of particulate matter (dust) from combustion flue gases. In practice, systems like this are used to remove dust from the flue gases prior to its entry into a thermal oxidizer for thermal treatment. This system relies upon the addition of a conditioning agent into the gas stream prior to its passing through an electrostatic precipitator. The conditioning agent is used to enhance removal of unwanted dust.

Reducing dust accumulation inside the thermal oxidizer by having dust removed from the flue gases before it enters the thermal oxidizer has the undesirable effect of preventing this dust from being decontaminated by the action of the thermal oxidizer. Consequently this contaminated dust must be further treated and decontaminated before it is disposed of, requiring additional effort and expense.

The addition of a conditioning agent to the flue gases also increases the total amount of particulate matter that the electrostatic precipitator must remove in order to prevent fouling of the thermal oxidizer. This system is an additional and separate device from the thermal oxidizer that has its own effort and expense required to fabricate and operate it. There is also the additional cost of supplying the conditioning agent which is constantly consumed during operation. Electrostatic precipitators also restrict the flow of flue gases through the system. This flow restriction reduces the entire system's throughput and efficiency.

Von Seebach et al. (U.S. Pat. No. 5,365,566) disclose an apparatus for treating the exhaust flow from a modified cement kiln burning hazardous waste. Their system for treating exhaust gases is directed at the problems caused by the formation and accumulation of low-melting point alkali chloride salts. This was done by using a number of cyclonic separators connected to each other by a system of ducts. The scale and complexity of this method limits its cost effectiveness and makes it impractical for use in smaller or portable systems. These same factors also reduce this system's cost effectiveness when it is used in larger stationary installations.

Cyclone separators in general have been observed to have difficulty in removing dust particles smaller than 150 microns in size. This leaves the smaller dust particles suspended in the gas stream until it enters the thermal oxidizer where the gas stream loses velocity as a result of increased cross sectional area. At the lower velocity inside the thermal oxidizer, the gas stream can no longer carry these smaller dust particles along with it. These smaller dust particles then separate out of the gas stream to accumulate on the bottom inside the thermal oxidizer.

When cyclone separators are used in conjunction with thermal oxidizers, there is a pressure drop of 20 to 30 percent across the cyclone separator. This was observed by the inventors when they attempted to solve their dust accumulation problem by using cyclone separators. This pressure drop directly translates into a reduction of flue gas throughput by 20 to 30 percent which degrades system efficiency accordingly. Another problem observed when using cyclone separators is that the dust removed from the flue gases before treatment in the thermal oxidizer has yet to be decontaminated. This dust has its own additional treatment and disposal problems.

Wager et al. (U.S. Pat. No. 5,501,161) disclose a process that uses a filter to remove the dust from a gas stream that is at a sufficiently high temperature to treat certain particulate matter contaminants that are in the dust. This process was never meant to treat and decontaminate flue gases sufficiently for discharge out to the atmosphere nor does it effectively deal with dust removal from a gas treatment device such as a thermal oxidizer. As is the case with prior practice thermal oxidizers, this system must periodically be shut down, allowed to cool down (a process that can take as long as six days), and then disassembled to be cleaned manually. Another problem with this apparatus is the expense of filter elements made to withstand the high temperatures at which this system operates.

Birmingham et al. (U.S. Pat. No. 4,444,735), Bayer et al. (U.S. Pat. No. 5,376,340), and Klobucar (U.S. Pat. No. 5,352,115) all disclose heat exchangers incorporated as an integral part into a thermal oxidizer. Most thermal oxidizers in use today have some kind of heat exchanger or multiple heat exchangers incorporated into the overall system or into the thermal oxidizer itself. Heat exchangers of a variety of types and designs for use with or in thermal oxidizers are commercially available.

Although not directly related to the removal of dust that accumulates inside thermal oxidizers, investors such as Falla (U.S. Pat. No. 1,794,006), Maxwell (U.S. Pat. No. 2,242,653), Reilly (U.S. Pat. No. 2,983,234) disclose a variety of mechanical means to remove ash from various combustion systems. When we tried a number of these mechanical devices to remove dust from a thermal oxidizer, we found them to all have a number of problems in common with each other.

The very hot and very fine dust that accumulates inside a thermal oxidizer tends to stay put unless it is directly pushed. Gravity is insufficient to get the dust to fall by itself into these various mechanical devices. When the dust was directly moved by mechanical means, the heat of the dust warped the moving parts and its abrasive qualities caused rapid wear. This breakage and wear of mechanical dust removal devices built into the thermal oxidizer was a problem directly experienced in our early dust removal experiments.

We also experienced the loss of system efficiency coupled with the problem of contaminated dust disposal that was presented by devices that remove dust prior to treatment of flue gases and the high cost of fabrication and maintenance for all of these systems.

SUMMARY OF THE INVENTION

It is accordingly an object of the invention to provide an apparatus and method for the periodic removal of accumulated particulate matter (such as dust) from the inside of a thermal oxidizer regardless of whether or not it is currently in operation.

It is a further object of the invention to provide a cost effective apparatus and method for the periodic removal of accumulated dust from the inside of a thermal oxidizer that is simple to construct, operate, and maintain.

It is also object of the invention to provide a cost effective means of improving existing thermal oxidizers by converting them into self cleaning thermal oxidizers by retrofitting them.

According to another object of the present invention, the effort and expense of cleaning out accumulated dust from the inside of a thermal oxidizer by ceasing operation, allowing a cool down for five or six days, followed by disassembly, manual cleaning, and reassembly is substantially reduced or eliminated.

It is also an object of this invention to avoid the effort and expense of additional and separate devices to remove dust directly from a thermal oxidizer or from the flue gases prior to their entry into a thermal oxidizer.

Another object of the present invention is to enhance the efficiency of flue gas treatment by avoiding flow restrictions imposed on the process by the inclusion of additional and separate devices to remove dust from the flue gases being treated by a thermal oxidizer.

An additional object of the present invention is to treat and decontaminate the dust prior to its removal from the system.

Additionally it is an object of the present invention to accomplish this dust removal using the least possible amount of additional air to minimize the total amount of flue gases that must pass through the baghouse filter.

During normal operation the self cleaning thermal oxidizer runs in a manner typical of most. Contaminated flue gases to be treated enter the thermal oxidizer passing around a natural gas (or other fuel) burner. The burning fuel and air mix with the flue gases breaking them down and oxidizing the contaminants within the flue gases.

When particulate matter (such as dust) accumulates to a predetermined level, or when a loss in efficiency due to dust accumulation is detected, or at some kind of regular interval, a compressed air valve is opened either manually or automatically during the cleaning cycle to remove the dust from the thermal oxidizer. The compressed air released by the valve travels through a pipe to the interior of the thermal oxidizer where it is vented through a compressed air discharge nozzle assembly or a series of compressed air discharge nozzle assemblies mounted within the thermal oxidizer.

This compressed air valve can be of the type controlled manually or of the type controlled automatically. One embodiment of the present invention has its compressed air controlled manually by an individual opening the valve to provide a blast of compressed air for the duration of the cleaning cycle once a day. This manually controlled cleaning cycle usually lasted no more than a minute or two before the valve was manually closed.

Automatic control of the compressed air valves can be programmed to deliver a continuous blast or a series of pulses of compressed air at a pressure and frequency selected for optimal cleaning performance for that given set of conditions. The compressed air blast or train of pulses blows the accumulated dust back up into the main flow of the flue gases. With the dust returned into the main flow of the flue gases, the dust is subjected to the same decontamination treatment as the flue gases.

The flue gases carry the dust out of the thermal oxidizer, usually through one or more heat exchangers, then finally to a fabric filter baghouse. The heat exchangers reduce the temperature of the flue gases to about 300 degrees Fahrenheit before they enter the fabric filter baghouse. This reduced temperature of the flue gases makes it possible to use low cost conventional filters.

The fabric filter baghouse removes the dust from the cooled and decontaminated flue gases before these flue gases are exhausted to the outside atmosphere. The dust output from the fabric filter baghouse has also been treated and decontaminated to the point that it can be disposed of conventionally.

In larger versions of the self cleaning thermal oxidizer, a series of compressed air discharge nozzle assemblies would be mounted along the bottom of its entire length. During a cleaning cycle, the blast or pulse train of compressed air through each nozzle assembly could be coordinated to optimize dust removal. For example, the nozzle assembly nearest to the flue gas entrance would be the first to blow or pulse followed by the next nozzle assembly, one after the other to the last nozzle assembly nearest the flue gas exit. This timing coordination would blow the dust up from each section into the main flow of the flue gas in turn as it travels along the length of the thermal oxidizer preventing resettling of the dust inside it.

It is within the scope of the present invention to use a variety of different compressed air discharge nozzle assembly configurations and control strategies to optimize system performance for each thermal oxidizer design and for each given set of operating conditions.

By using high pressure air, such as 90 p.s.i., a relatively low volume of air is needed during each cleaning cycle to dislodge the accumulated dust and get it back up into the flow of the flue gas. The low volume of air needed for the cleaning cycle is significant because it reduces the overall volume of flue gases that must pass through the baghouse filters.

The particulate matter (such as dust) blown up into the flue gases is moved out of the thermal oxidizer by the flue gases, then usually through a heat exchanger or two to reduce the flue gas temperature, and then on to a fabric filter baghouse. The reduced cross section inside the heat exchangers raises the velocity of the flue gases passing through them causing the dust to remain suspended in and transported by the flue gases to the fabric filter baghouse. The dust filtered out of the flue gas by the filter baghouse has already been cooled by the heat exchangers to about 300 degrees Fahrenheit so that it will not damage conventional and relatively inexpensive fabric filters used within the baghouse. This dust has also been treated and decontaminated by the thermal oxidizer and can be removed from the baghouse filter and disposed of by conventional means without requiring further treatment.

The large number of thermal oxidizers already in use can also be economically retrofitted with the present invention to become self cleaning thermal oxidizers. For example, this conversion when applied to horizontal thermal oxidizers is done by removing its internal refractory material and cutting a series of holes through the bottom of its main body. These holes are spaced at regular intervals along its length and are of an appropriate diameter for pipes to pass through and be welded in place.

The upper end of each of these pipes would have a compressed air discharge nozzle assembly mounted on it (preferably from the inside of the oxidizer), so that these nozzles would be located at a similar level of about two to three feet above the bottom of the inside of the thermal oxidizer. The refractory material is then re-installed with allowances made for the pipes up to the compressed air discharge nozzles. The pipes extending outside and below the main body of the thermal oxidizer can each have a compressed air valve between each pipe and a compressed air manifold or all of these pipes could be attached to the compressed air manifold which has a compressed air valve between it and the compressed air source.

These compressed air valves can be of manual or automatic operation. The most primitive system would have a single manual valve controlling the compressed air going to the manifold supplying all of the nozzles. The most sophisticated system would have an automatic valve controlling the compressed air to each individual nozzle and all of the automatic valves would be operated by a process control computer.

Most thermal oxidizers presently in the field already have heat exchangers, a filter baghouse, and most of the other additional equipment needed for the retrofitted thermal oxidizer to be operated as a self cleaning thermal oxidizer. This retrofit modification would be much less expensive than purchasing a totally new self cleaning thermal oxidizer.

With the increased use of thermal oxidizers in soil remediation systems, the rapid accumulations of very fine dust inside them has become a major engineering challenge. The simplicity and effectiveness of the present invention in dealing with this dust removal problem will reduce the cost and increase the efficiency of soil remediation and other pollution reduction and abatement systems that use thermal oxidizers to the benefit of all.

BRIEF DESCRIPTION OF THE DRAWINGS

The above and other objects and features of the present invention will be clearly understood from the following description with respect to the preferred embodiments thereof when considered in conjunction with the accompanying drawings, in which.

DETAILED DESCRIPTION OF THE PREFERRED EMBODIMENTS

Figure 1:
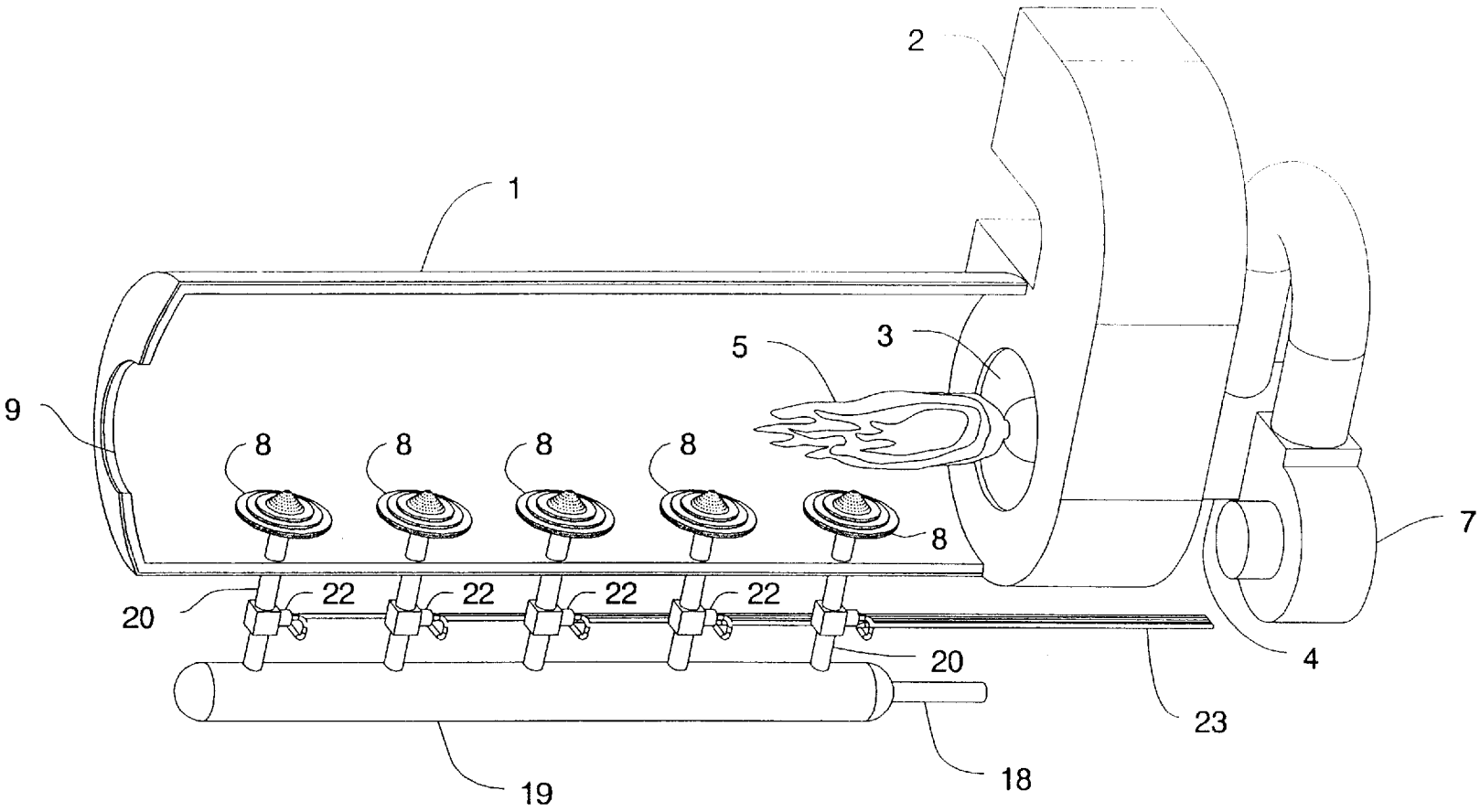
FIG. 1 is a perspective and partially cut away view of a thermal oxidizer including an apparatus for self cleaning according to the present invention.
Figure 2:
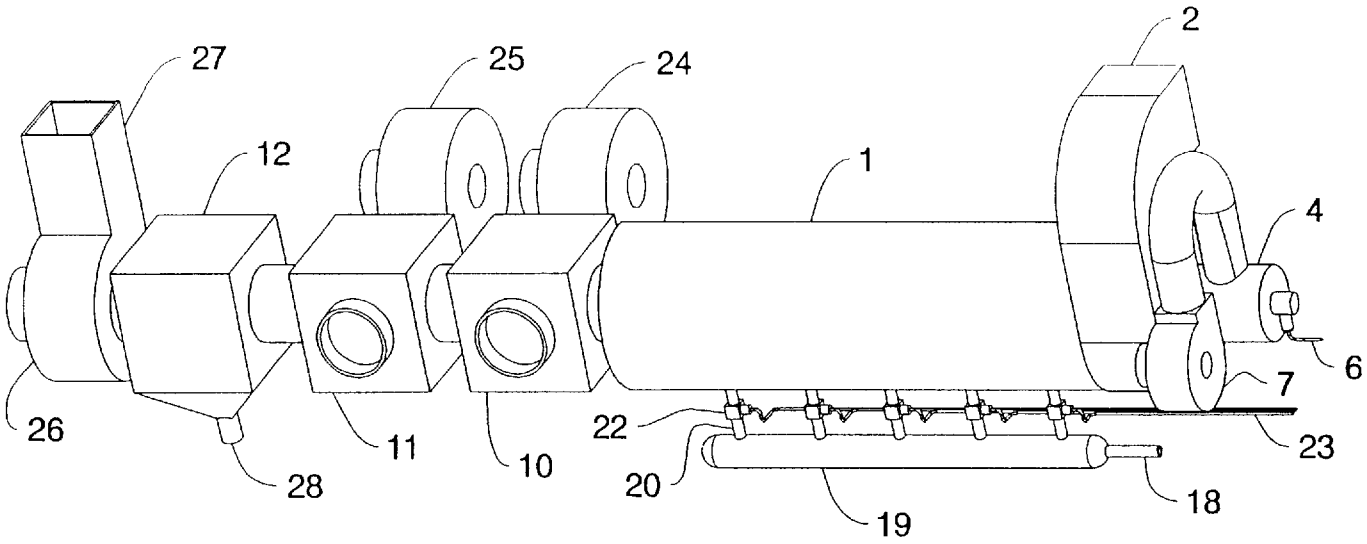
FIG. 2 is a perspective view of the entire flue gas treatment system including the self cleaning thermal oxidizer.
Figure 3:
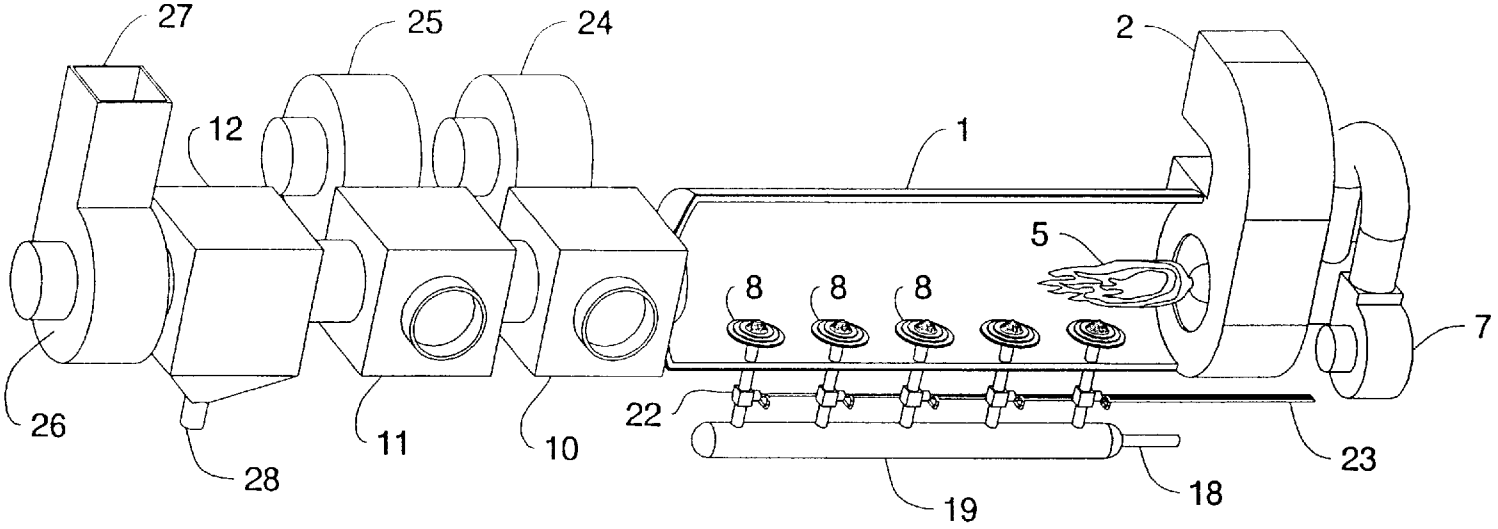
FIG. 3 is a perspective and partially cut away view of the entire flue gas treatment system including the self cleaning thermal oxidizer.

The present invention will now be described in further detail in conjunction with a preferred embodiment of a self cleaning thermal oxidizer 1 capable of cleaning out dust from its interior without needing to be shut down or cooled down. As shown in FIGS. 1–3, the thermal oxidizer 1 can conduct a cleaning cycle regardless of whether or not it is currently in operation.

Contaminated flue gases to be decontaminated by thermally treating them in the thermal oxidizer 1 enter it by traveling through a duct 2 into a flue gas entrance port 3. A burner 4, such as the natural gas Beta Burner manufactured by the Hauck Co. of Lebanon, Pa., is mounted to introduce a flame 5 into the center of the flue gas entrance port 3. While this burner is disclosed as burning natural gas, it is also possible to select a burner that operates on propane, diesel, waste oil or any other appropriate fuel and the burner may be manufactured by any other company. The burner 4 is supplied with fuel, such as natural gas, by a fuel line 6 and is supplied with air from a centrifugal air blower 7. It is also possible to use compressed air or both compressed air and an air blower to supply additional air. The burner 4 creates the flame 5 which provides the combustion and heat needed to achieve an internal temperature of approximately 950–1600 degrees Fahrenheit. This heat and the introduction of some additional air are used inside the thermal oxidizer 1 to thermally treat, oxidize, and destroy contaminates contained in the flue gases and in the dust carried by the flue gases. The required temperature needs to be high enough to destroy the contaminates while keeping fuel efficiency in mind.

As the burning flue gases travel the interior length of the thermal oxidizer 1, the increased cross sectional area inside causes the flue gases to reduce their velocity thus allowing dust to precipitate out of the flue gases. The dust then accumulates on the bottom of the thermal oxidizer 1. Positioned at regular intervals along the bottom of the thermal oxidizer 1 are a series of compressed air discharge nozzle assemblies 8 that are part of the apparatus for allowing self cleaning of the thermal oxidizer 1

When the dust accumulation in side the thermal oxidizer 1 reaches a certain level, or at some interval of time, compressed air is discharged through the compressed air discharge nozzle assemblies 8. This compressed air blast or train of pulses dislodges the deposited dust blowing it back up into the main flow of the burning flue gases. This dislodged dust is transported along with the flue gases inside the thermal oxidizer 1, and out through a flue gas exit port 9, then through a first air to air heat exchanger 10, through a second air to air heat exchanger 11, and finally to a fabric filter baghouse 12.

Figure 4:
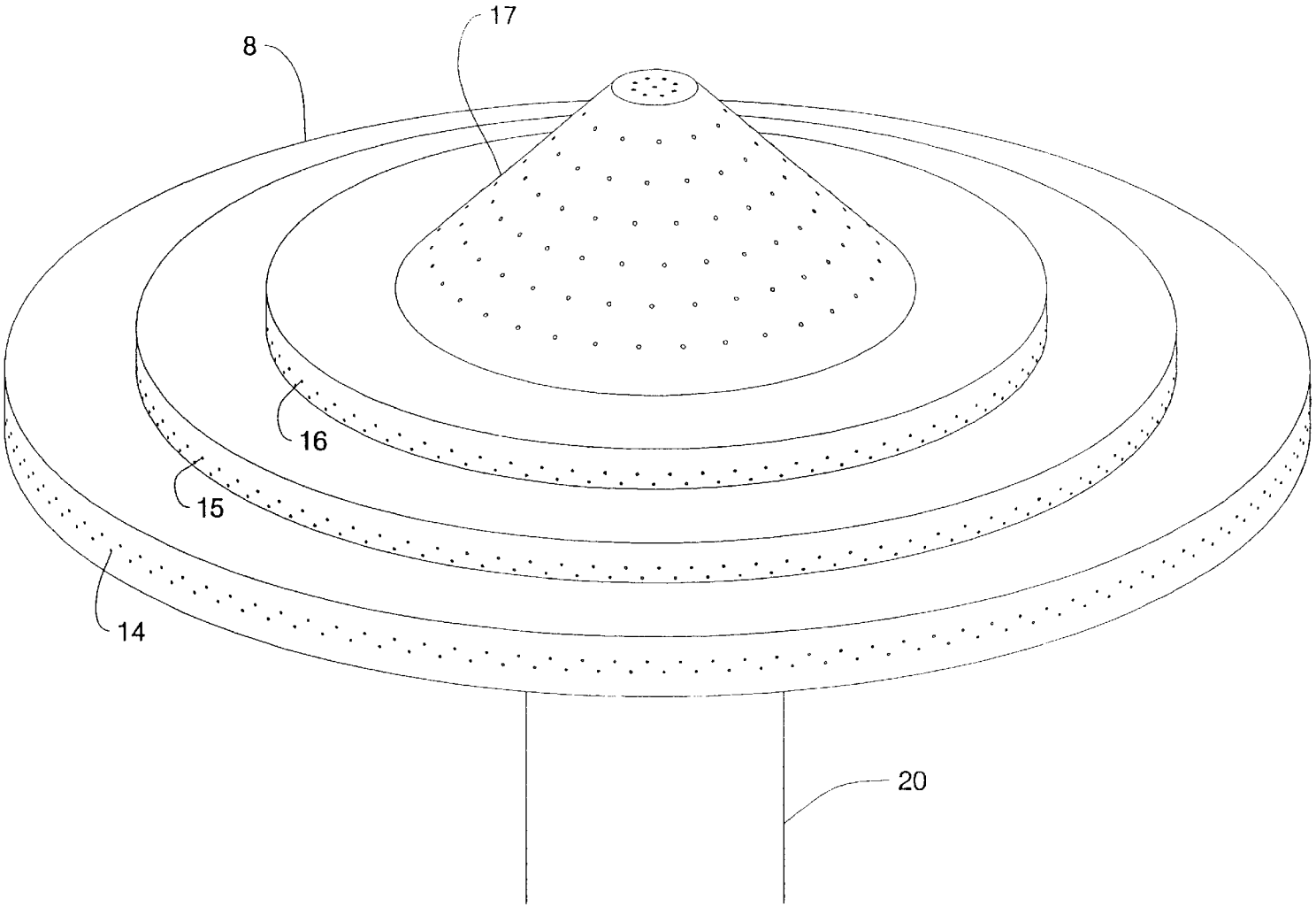
FIG. 4 is a detailed perspective view of a compressed air discharge nozzle assembly according to the present invention.
Figure 5:
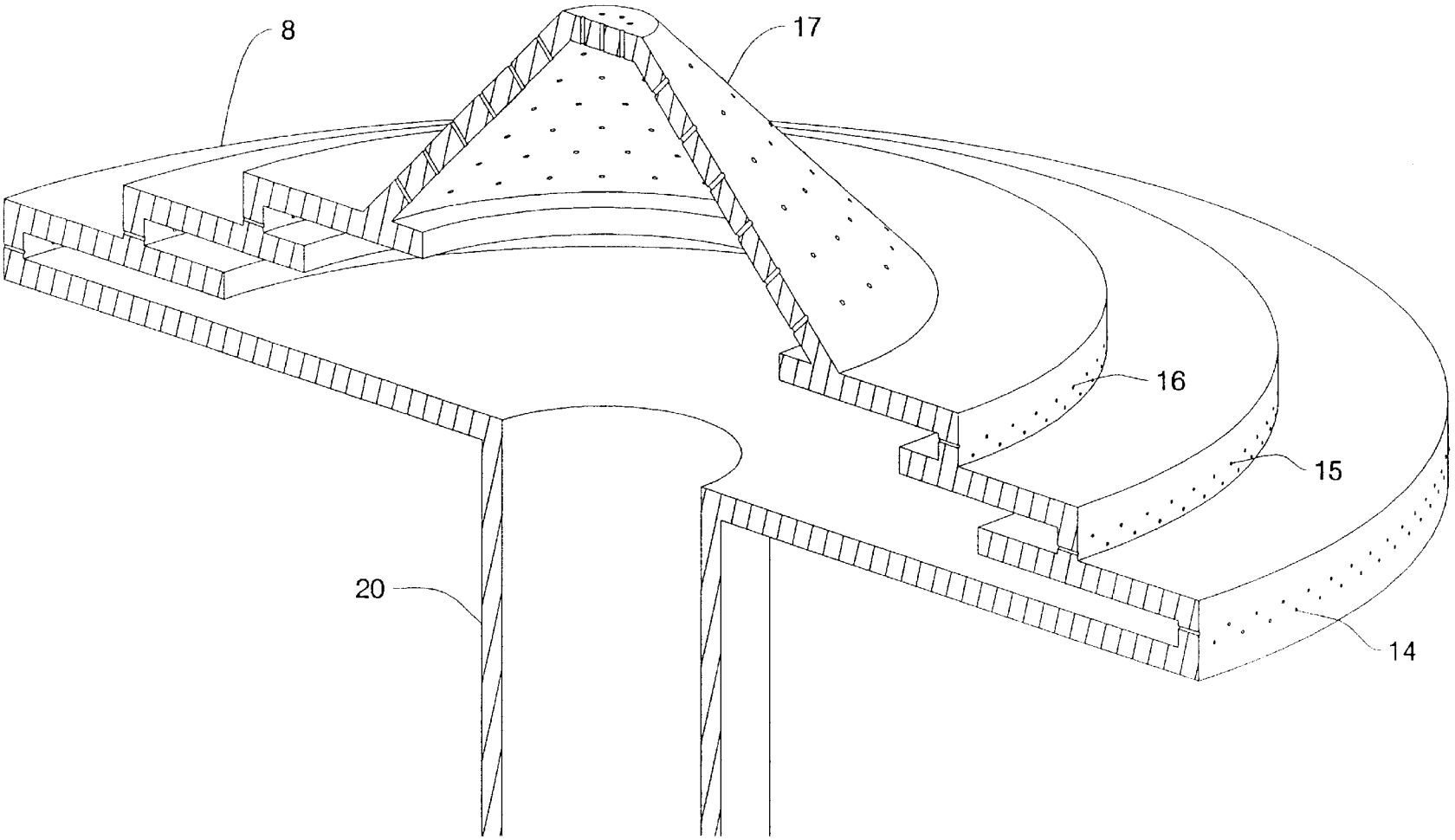
FIG. 5 is a perspective and partially cut away view of a compressed air discharge nozzle assembly according to the present invention.

As seen in FIG. 4, the compressed air discharge nozzle assemblies 8 vent the compressed air out through a number of holes that go through a lower cylindrical surface 14, a middle cylindrical surface 15, an upper cylindrical surface 16, and a truncated cone surface 17. The size and orientation of these air discharge holes through the lower cylindrical surface 14, the middle cylindrical surface 15, the upper cylindrical surface 16, and the truncated cone surface can be of a variety of sizes or orientations depending upon what works best for a given set of operating conditions.

The compressed air that is released through each of the compressed air discharge nozzle assemblies 8 enters the system from a source of compressed air and passes through a compressed air line 18 to a compressed air manifold 19. The compressed air manifold 19 includes a number of compressed air lines 20 leading to each of the compressed air discharge nozzle assemblies 8. Each of the compressed air lines 20 that supply each of the compressed air discharge nozzle assemblies 8 enters through the bottom of the self cleaning thermal oxidizer 1 and also acts as a support for each of the compressed air discharge nozzle assemblies 8.

Figure 6:
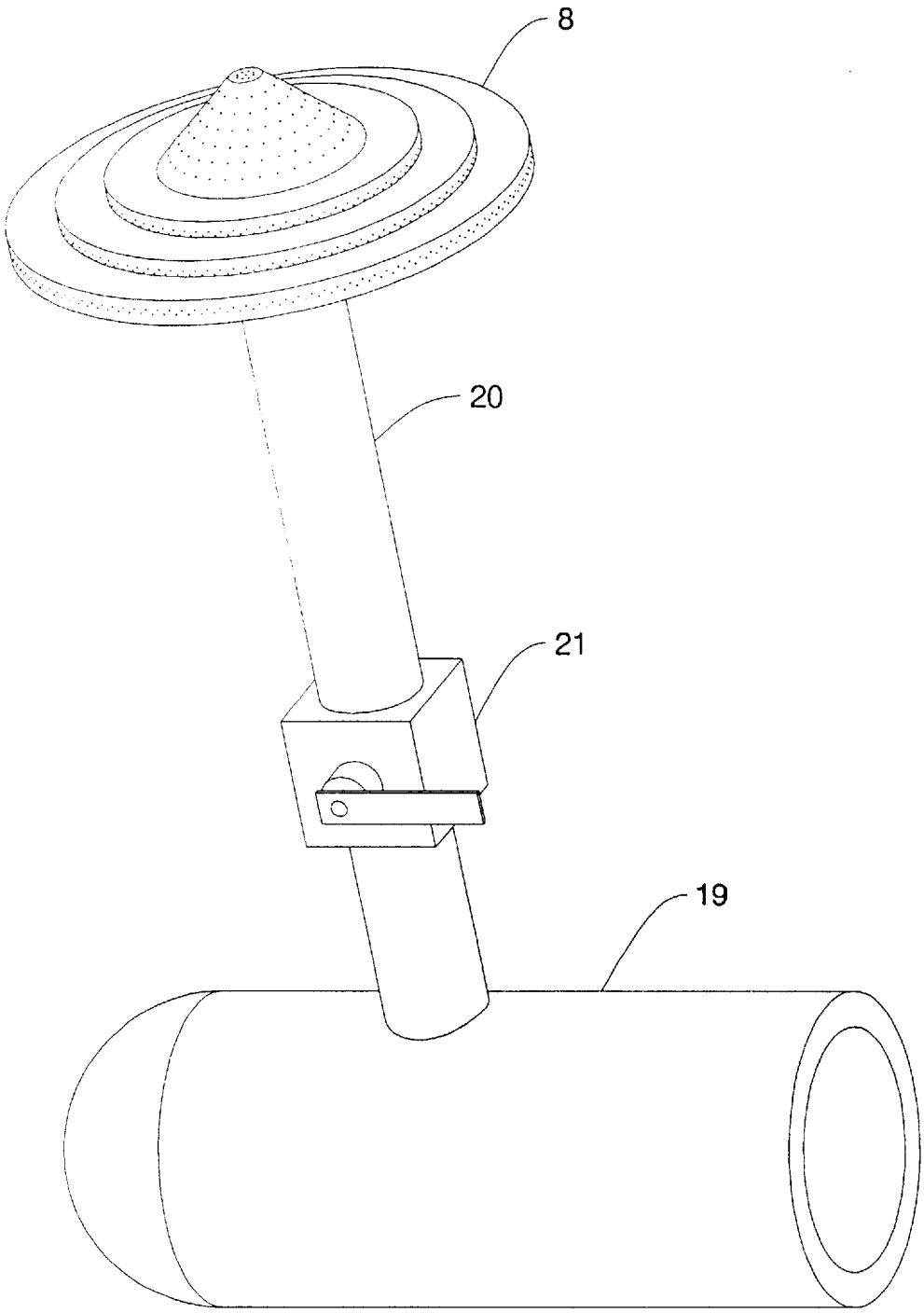
FIG. 6 is a perspective view of a compressed air discharge nozzle assembly controlled by a manual valve according to the present invention.
Figure 7:
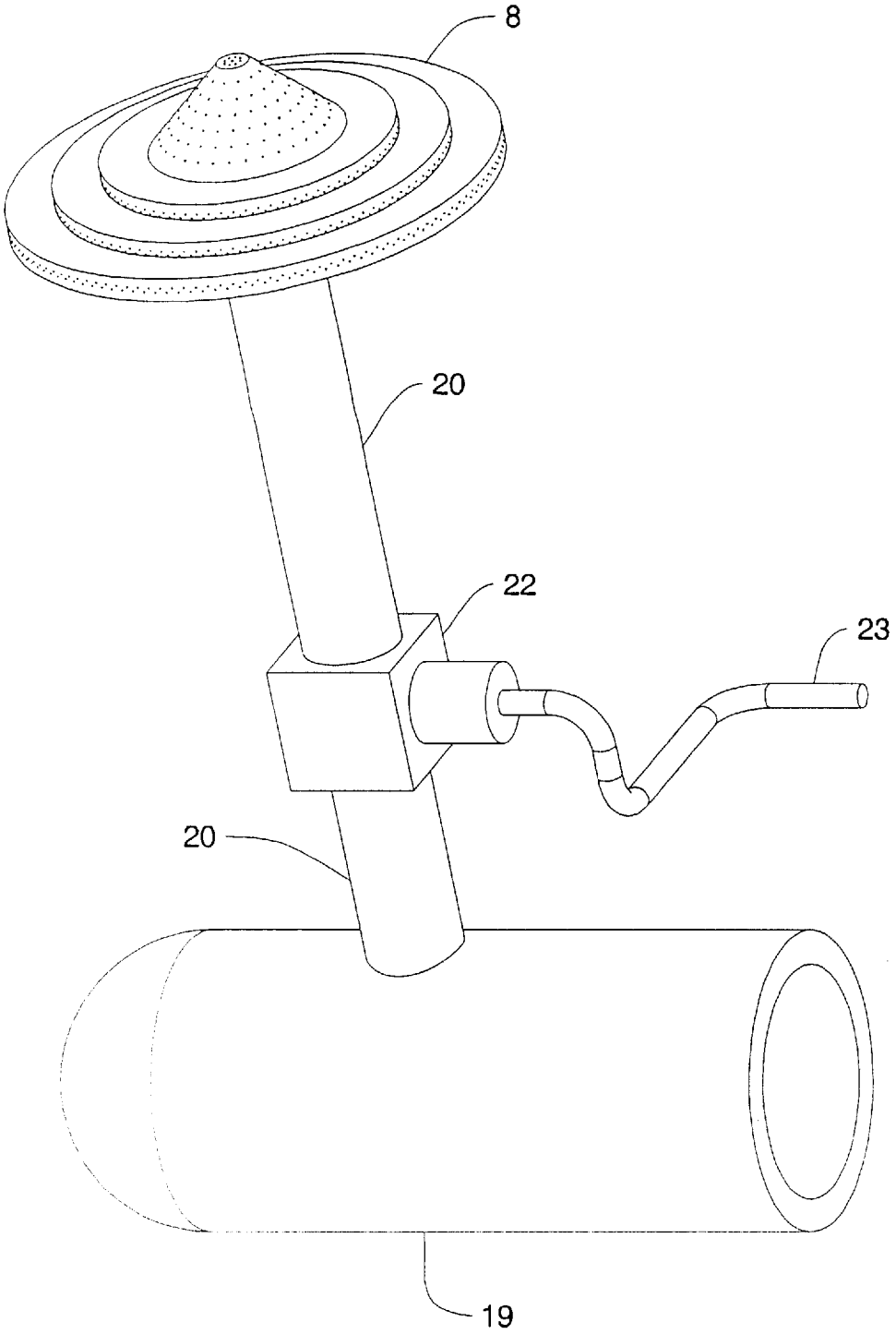
FIG. 7 is a perspective view of a compressed air discharge nozzle assembly controlled by an automatic valve according to the present invention.

The compressed air discharge nozzle assemblies 8 have the supply of compressed air controlled by a manual valve 21 (FIG. 6) or an automatic valve 22 (FIG. 7) mounted in the compressed air line 20 under the thermal oxidizer 1 and above the compressed air manifold 19. The automatic valves 22 in the system so equipped are controlled by a signal that arrives via a control signal line 23. This control signal sent through the control signal line 23 to the automatic valves 22 can originate from a variety of process control devices such as relays, programmable logic controllers, or process control computers (not shown). The compressed air supplied to each of the compressed air discharge nozzle assemblies 8 can be strategically controlled by some kind of process control to provide a continuous blast or a train of the pulses of compressed air selected for optimal removal of the dust with the least resettling of dust inside the self cleaning thermal oxidizer 1 for a given set of operating conditions.

The exact pressures of the compressed air can vary over a wide range of pressures from a very low pressure to a very high pressure depending on how much throughput is required for the system. The pressure depends on the size of the nozzles being used and where the buildup is occurring. For example, it is possible that more pressure may be needed in one side of the unit and less pressure in another part of the thermal oxidizer. This type of pressure variation can be accomplished by using different size nozzles in the same unit or by using air pressure regulators. Typically, the pressure range is between 10–400 psi with around 80 psi being used in many cases. It is also possible to use higher and lower pressures in particular situations. One of the main goals is to try to keep the volume of air low so the flow stream and baghouse filter operation are not significantly disturbed when adding air from the nozzle assemblies.

The sequence of operating the nozzles can vary as much as the pressures depending on the type and amount of buildup that is occurring in the thermal oxidizer. One way of checking the amount of buildup is to operate the system for a time with the nozzles in place and then cool the system down and observe the particular locations of buildup. This observation can then assist in determining whether a particular area or nozzle should be pulsed more than another area. It may be necessary to pulse the same compartment more than another compartment to keep them clean. The pulsing operation puts a blast of compressed air through the nozzle assembly to raise up the dust and particulate matter into the air stream of the system. The length of the pulses can also vary. For example, one nozzle may be pulsed for one second and another nozzle may be pulsed for $\frac{1}{8}^{th}$ of a second depending on the amount of buildup and where it is occurring.

As mentioned above, it is possible to have a pulse system that can vary the pulse sequence automatically. This system would allow pulsing one nozzle for a longer amount of time than another nozzle and it would also allow changing the timing of when a nozzle will be pulsed making it easier to pinpoint problem areas and keep them free of dust or buildup.

The control signal line 23 is typically connected to a pulse board (computer board with timers to vary the length of the pulse and timing for opening the valve) or a computer system. The connection can be made using 110, 220 or 480 volts and typically between 4–20 mA signals. It is also possible to manually control the valves by hand using the valve 21 shown in FIG. 6.

The dislodged dust and the flue gases transporting it leave the main body of the self cleaning thermal oxidizer 1 through the flue gas exit port 9. Before the dust is separated from the flue gases by the fabric filter baghouse 12, the decontaminated dust and the decontaminated flue gases carrying the dust are cooled down. The flue gases from the flue gas exit port 9 pass through the first heat exchanger 10 which cools the decontaminated flue gases and the dislodged dust carried along by it down to about 750 degrees Fahrenheit. Then the second air to air heat exchanger 11 further cools down the decontaminated flue gases and dislodged dust carried along by it further to a temperature of about 300 degrees Fahrenheit before it enters the fabric filter baghouse 12. The first air to air heat exchanger 10 is supplied with cooling air by a centrifugal blower 24 and the second air to air heat exchanger 11 is supplied with cooling air by another centrifugal blower 25.

The decontaminated flue gases and the decontaminated dust dislodged from the interior of the self cleaning thermal oxidizer 1 carried along by the flue gases, now cooled down to about 300 degrees Fahrenheit, are drawn into the fabric filter baghouse 12 by an exhaust blower 26. The fabric filter baghouse 12 separates the decontaminated flue gases from the decontaminated dust that was dislodged from inside the thermal oxidizer 1 during its cleaning cycle. The exhaust blower 26 draws the decontaminated flue gases through the fabric filter baghouse 12 and then out an exhaust stack 27 to the atmosphere.

The exhaust blower 26 attached to the fabric filter baghouse 12 is the primary air mover for the entire thermal oxidizer system in order to insure that any system leaks that might occur are leaks of fresh air into the system rather than contaminated flue gases out of the system. The decontaminated dust removed from the flue gases by the fabric filter baghouse 12 exits through a decontaminated dust output 28. This dust has been decontaminated by being thermally treated and can now be disposed of by conventional means.

Factors that typically indicate a buildup of material in the system affecting the operation of the self cleaning apparatus include: the type of material being run; the damper settings that control air flow through the system; the moisture in the material being treated; the throughput of the system; the temperature of the oxidizer; the size of the system; the type of refractory used; and whether the thermal oxidizer is vertically or horizontally arranged. Besides cooling the thermal oxidizer down completely, it is also possible to determine the amount of buildup by reviewing the operation of the burner to see if there is any back flow, or any turbulent flow or whether the burner does not fire easily. Also, a discoloration on the outside surface of the thermal oxidizer can indicate that the direction of the flame has been diverted due to a buildup.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. An apparatus for assisting the removal of particulate matter from an interior of a thermal oxidizer comprising:

a source of compressed air;

at least one compressed air outlet located inside the thermal oxidizer, said at least one compressed air outlet including a nozzle assembly mounted adjacent a bottom surface of the thermal oxidizer and said nozzle assembly including a truncated cone surface containing openings for compressed air to exit therefrom;

a conduit connected from said source of compressed air to said compressed air outlet; and a compressed air control valve that can vary an amount of compressed air released through said compressed air outlet.

2. An apparatus as defined in claim 1, wherein said compressed air control valve is a manually operated valve.

3. An apparatus as defined in claim 1, wherein said compressed air control valve is an automatic valve.

4. An apparatus as defined in claim 1, wherein said at least one compressed air outlet includes a series of outlets.

5. An apparatus as defined in claim 1, wherein said at least one compressed air outlet includes a series of nozzle assemblies.

6. An apparatus for assisting the removal of particulate matter from an interior of a thermal oxidizer, said apparatus comprising:

a source of compressed air;

a plurality of compressed air outlets located inside of the thermal oxidizer, said compressed air outlets are nozzle assemblies mounted adjacent a bottom surface of the thermal oxidizer and said nozzle assemblies include a truncated cone surface containing openings for compressed air to exit therefrom;

a plurality of conduits connected from said source of compressed air to said compressed air outlets; and at least one compressed air control valve that can vary an amount of compressed air released through at least one of said compressed air outlets.

7. An apparatus as defined in claim 6, wherein said compressed air control valve is a manually operated valve.

8. An apparatus as defined in claim 6, wherein said compressed air control valve is an automatic valve.

9. A treatment system including a thermal oxidizer, said system comprising:

a housing containing a refractory layer and a metal exterior layer, said housing including a flue gas entrance port and a flue gas exit port;

a plurality of compressed air outlets located adjacent an interior of said housing of said thermal oxidizer, said compressed air outlets include at least one cylindrical surface containing holes for compressed air to exit therefrom;

a source of compressed air;

a plurality of conduits connected from said source of compressed air to said compressed air outlets; and a plurality of compressed air control valves, each valve controlling flow of compressed air through a selected conduit of said plurality of conduits to one of said compressed air outlets.

10. A treatment system as defined in claim 9, further comprising:

a burner connected to said thermal oxidizer;

at least one heat exchanger connected to said flue gas exit port;

a baghouse filter connected to said heat exchanger; and an exhaust blower connected to said baghouse filter.

11. A treatment system as defined in claim 9, wherein said compressed air outlets include a truncated cone surface containing holes for compressed air to exit therefrom.

* * * * *